United States Patent [19]

Calavenna

[11] Patent Number: 4,961,250

[45] Date of Patent: Oct. 9, 1990

[54] WATCH BAND BUCKLE

[76] Inventor: Anthony M. Calavenna, 2804 Rhineberry, Rochester Hills, Mich. 48309

[21] Appl. No.: 410,838

[22] Filed: Sep. 22, 1989

[51] Int. Cl.[5] ..... A44B 1/04

[52] U.S. Cl. ..... 24/178; 24/188; 24/265 WS; 24/265 B

[58] Field of Search ..... 24/178 R, 170, 176, 24/186, 188, 265 WS, 265 BC, 163 R, 172, 265 B, 265 EC

[56] References Cited

U.S. PATENT DOCUMENTS

| | | | |
|---|---|---|---|
| 644,314 | 2/1900 | Bates . | |
| 1,852,585 | 4/1932 | McDonald . | |
| 1,965,415 | 7/1934 | Hirsh | 24/186 |
| 2,418,096 | 3/1947 | Robinson | 24/178 R |
| 2,595,264 | 5/1952 | Jespersen | 24/176 |
| 2,757,427 | 8/1956 | Steinberg | 24/178 R |
| 3,036,352 | 5/1962 | Kehrer | 24/178 R |
| 3,252,194 | 5/1966 | Albiniano | 24/178 R |

*Primary Examiner*—Laurie K. Cramer
*Attorney, Agent, or Firm*—Basile and Hanlon

[57] ABSTRACT

A buckle for a band includes a frame formed of first and second spaced side bars and first and second end bars joined to opposite ends of the first and second side bars. An intermediate bar extends between and is joined to the first and second side bars and is disposed intermediate the first and second end bars. A tongue is connected to the intermediate bar for releasably engaging one of a plurality of apertures formed in the band. In one embodiment, the intermediate bar and the tongue are rigidly joined together and the intermediate bar is pivotally connected to the first and second side bars. In this embodiment, an auxiliary end bar is rigidly joined to one end of the side bars and spaced from the second end bar. In another embodiment, the intermediate bar is rigidly connected to the first and second side bars and the tongue is pivotally connected to the intermediate bar. The intermediate position of the intermediate bar between the first and second end bars forms an opening between itself and one of the first and second end bars for receiving the free end of the band therethrough and enabling the free end of the band to be passed underneath the other end of the band joined to one of the end bars of the frame after one of the apertures in the band has been engaged by the tongue.

2 Claims, 1 Drawing Sheet

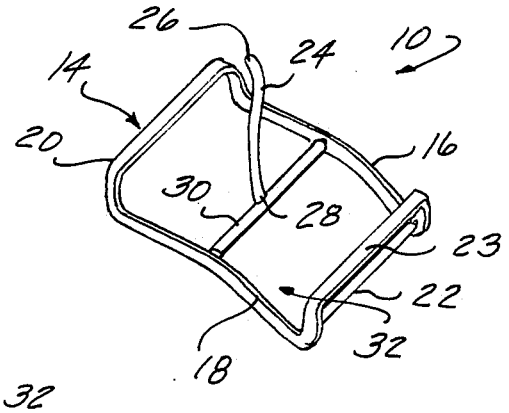
FIG-1
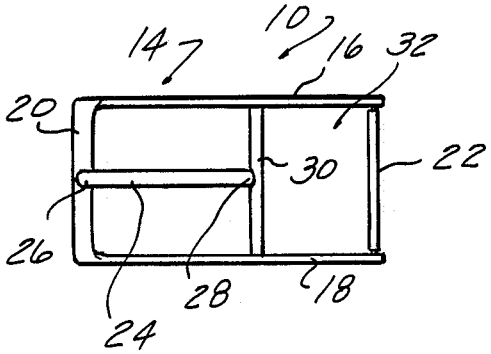
FIG-2
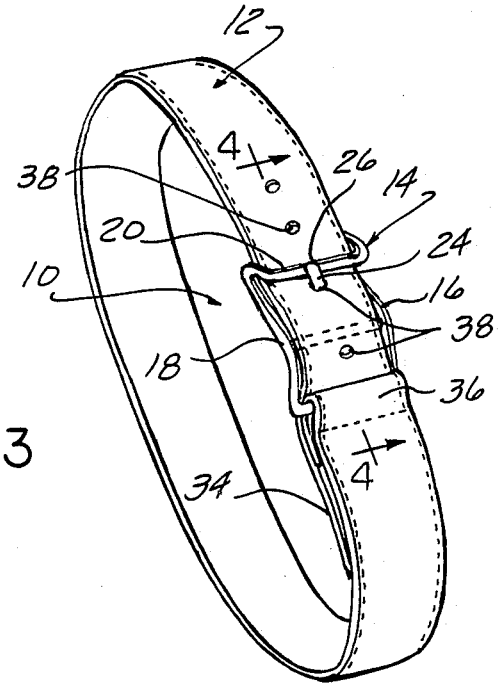
FIG-3
FIG-4
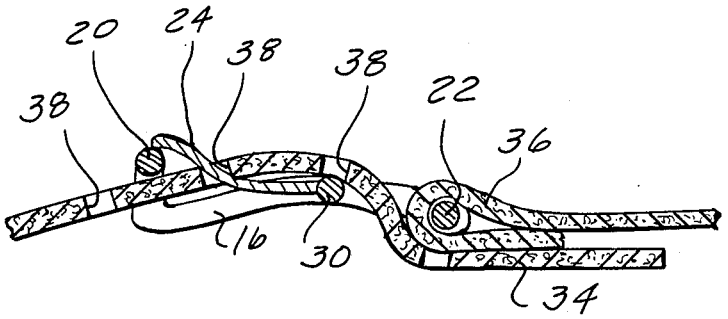

WATCH BAND BUCKLE

BACKGROUND OF THE INVENTION

1. Field of the Invention

The present invention relates, in general, to fasteners for straps, such as wrist watch bands and, specifically, to buckles for straps, such as wrist watch bands.

2. Description of Relevant Art

Fasteners, such as buckles, have long been employed to join the ends of a strap or band, i.e. wrist watch bands, belts and the like, together. Such buckles typically include a frame which is connected to one end of the strap or band. The other or free end of the band engages a portion of the frame to secure the band about the wrist or waist of the user.

Typically, a tongue is pivotally mounted at one of the frame and releasably engages one of a plurality of spaced apertures formed in and extending from the free end of the band. The free end of the band, after engagement with the tongue, passes over the exterior surface of the other end of the band which is joined to the buckle. An additional loop is attached to the other end of the band to secure the free end of the band in place over the exterior surface of the other end of the band.

However, such an additional loop adds to the manufacturing and material costs of the band or strap. Furthermore, even with the loop, the free end of the band is free to move about during use which causes fraying of the free end of the band. Thus, it would be desirable to provide a buckle for joining the ends of a band or strap together which eliminates the need for an additional loop to secure the free end of the band in place after engagement with the buckle.

Several attempts have been made to devise buckles which address these problems. Such buckles include projections mounted on one end of the buckle frame which engage the band or strap or apertures in the band and enable the free end of the band to be passed through the frame and underneath the bottom surface of the other end of the band which is connected to the frame. None of these buckles, however, make use of a pivotal tongue to releasably engage apertures in the band and which, at the same time, enables the free end of the band to be passed through the buckle and secured in place underneath the other end of the band.

Thus, it would be desirable to provide a buckle for a band, such as a wrist watch band, which eliminates the need for the conventional loop applied to such bands to secure the free end of the band in place after the free end has engaged the buckle. It would also be desirable to provide such a watch band buckle which is of simple construction. It would also be desirable to provide such a buckle which includes a pivotal tongue to releasably engage one end of the band to join the ends of the band together. Finally, it would be desirable to provide a buckle and a buckle watch band in which the free end of the band is securely held in place without movement thereby preventing any fraying of the free end of the band.

SUMMARY OF THE INVENTION

The present invention is a buckle for a band or strap, such as a wrist watch band, belt and the like. The buckle includes a frame having first and second opposed side bars and first and second spaced end bars joined to and extending between the ends of the first and second side bars. A buckle includes a tongue which is pivotally mounted to the frame. The means for pivotally mounting the tongue to the frame is connected to the frame and spaced from the first and second end bars to form an opening between itself and one of the first and second end bars of the frame. The opening receives the first end of the band after the first end of the band has been engaged by the tongue and enables the first end of the band to be slid underneath the second end of the band which is connected to the other end bar of the frame.

In one embodiment, the tongue is rigidly connected to an intermediately disposed bar which is pivotally connected at its ends to the first and second side bars of the buckle frame. In this embodiment, an auxiliary end bar is rigidly joined to the side bars and spaced above the second end bar to provide structural integrity for the buckle. In another embodiment, the intermediate bar is rigidly connected to the first and second side bars of the frame and has the tongue pivotally mounted thereon.

In both embodiments, the intermediate bar is spaced from the second end bar of the frame to create the opening through which the first or free end of the band passes after the free end of the band has been engaged by the tongue.

The buckle of the present invention enables a band or strap, such as those commonly employed for wrist watch bands, to be constructed without the need of the additional loop commonly employed to secure the free end of the band over the opposite end of the band after the free end of the band has been engaged by the buckle. This simplifies the construction of the buckle and provides a buckle having a clean, aesthetic appearance. Furthermore, the free end of the band is held securely in place without movement thereby preventing any fraying of the end of the band.

BRIEF DESCRIPTION OF THE DRAWING

The various features, advantages and other uses of the present invention will become more apparent by referring to the following detailed description and drawing in which:

FIG. 1 is a perspective view of a buckle constructed in accordance with one embodiment of the present invention;

FIG. 2 is a plan elevational view of another embodiment of the buckle;

FIG. 3 is a perspective view of the buckle depicted in FIG. 1 shown mounted on a wrist watch band; and FIG. 4 is a cross sectional view generally taken along line 4—4 in FIG. 3.

DESCRIPTION OF THE PREFERRED EMBODIMENTS

Throughout the following description and drawing, an identical reference number is used to refer to the same component shown in multiple figures of the drawing.

As shown in the drawing, and in particular to FIGS. 1, 2 and 3, the present invention is a buckle 10 for a band or strap 12, such as a wrist watch band, which is employed to secure the ends of the band or strap 12 together with the free end of the band 12 passing through the buckle 10 and secured in place underneath the bottom surface of the opposite end of the band which is connected to the buckle 10. This buckle construction eliminates the need for an additional loop commonly employed on such bands to retain the free end of the band in position after the free end of the band has passed through and engaged the buckle.

As shown in FIGS. 1 and 2, the buckle 10 includes a frame 14 formed of first and second, spaced, opposed, side bars 16 and 18, respectively. Each of the first and second side bars 16 and 18 is substantially identical in construction and preferably has a planar, flat shape along its length. The lateral width of the first and second side bars 16 and 18 may have any shape, such as the arcuate or curved shape shown in FIG. 1. The shape of the first and second side bars 16 and 18 is chosen for aesthetic purposes as well as to provide connection to the remaining components of the buckle 10 as described hereafter.

The frame 14 also includes first and second end bars 20 and 22, respectively. The first and second end bars 20 and 22 extend between and are joined to opposite ends of the first and second side bars 16 and 18.

The shape of the first and second end bars 20 and 22 may be selected as desired by the designer of the buckle 10 and may have a generally planar or flat shape or a slightly curved or arcuate shape as shown in FIG. 1.

The frame 14 formed of the first and second side bars 16 and 18 and the first and second end bars 20 and 22 may be formed of any suitable material, preferably metal, and constructed as a substantially single piece structure by stamping or other forming methods. Typically the second end bar 22 is provided as a separate piece and separately joined to one end of the first and second side bars 16 and 18.

Combinations of integral end bar/side bar construction and separately joined end bars may also be employed. Thus, by way of example only, the first end bar 20 shown in FIG. 1 is illustrated as being a continuous, integral extension between the first and second side bars 16 and 18. Although the second end bar 22 may be rigidly joined to the first and second side bars 16 and 18 by soldering, etc., or as a single piece stamping, it is typically removably connected to the side bars 16 and 18. To achieve this, the second end bar 22 is constructed with outwardly biased pins which engage apertures formed in one end of the first and second side bars 16 and 18 to releasably connect the second end bar 22 to the first and second side bars 16 and 18. This enables the band, described hereafter, to be removed from the buckle 10 for repair or replacement.

The buckle 10 also includes a tongue 24. The tongue 24 generally is a planar, rod-like member. The tongue 24 may be straight or have an arcuate shape, as shown in FIGS. 1 and 4. The first end 26 of the tongue 24 is adapted to engage one of the apertures formed in the band 12, as described hereafter. The second end 28 of the tongue 24 is connected to an intermediate bar 30. The intermediate bar 30 forms a means for pivotally connecting the tongue 24 to the frame 14 of the buckle 10. The intermediate bar 30 has a generally planar configuration and is intermediately disposed between the first and second end bars 20 and 22 of the frame 14. The intermediate bar 30 extends between and is joined to the first and second side bars 16 and 18.

As shown in FIGS. 1 and 2, the intermediate bar 30 is spaced from the second end bar 22 a predetermined distance to define an aperture or opening 32 between itself and the second end bar 22. This opening 32 is adapted to slidingly receive the free end of the band 12, as described hereafter.

In one embodiment shown in FIG. 1, the tongue 24 and the intermediate bar 30 are formed as an integral, one piece assembly. In this embodiment, the intermediate bar 30 is pivotally connected to the first and second side bars 16 and 18 by suitable means, such as by spring biased pins mounted in and extending outward from the opposite ends of the intermediate bar 30 which engage apertures formed in the first and second side bars 16 and 18.

Further, due to the pivotal attachment of the intermediate bar 30 to the side bars 16 and 18 and the removable connection of the second end bar 22 to the side bars 16 and 18, additional support is needed in order to maintain the structural integrity of the buckle 10. This is achieved by an auxiliary end bar 23 disposed above and spaced from the second end bar 22. The auxiliary end bar 23 preferably has the same shape as the first end bar 20 and is rigidly joined at its ends to the ends of the side bars 16 and 18. The space between the second end bar 22 and the auxiliary end bar 23 receives the second end of the band, as described hereafter.

In another embodiment shown in FIG. 2, the intermediate bar 30 is rigidly connected to the first and second side bars 16 and 18 and the tongue 24 pivotally mounted thereto, such as by looping the second end 28 of the tongue 24 around the intermediate bar 30. Due to the rigid connection of the intermediate bar 30 to the side bars 16 and 18, the frame 14 has sufficient structural integrity to eliminate the need for an auxiliary end bar as shown in FIG. 1.

The use of the buckle 10 of the present invention will now be depicted with a band 12 which is illustrated in FIGS. 3 and 4 as being a wrist watch band. It will be understood, however, that the band 12 may be any type of band, such as a belt, etc., secured around articles or a body part of a user.

As shown in FIGS. 3 and 4, the band 12 has first and second ends 34 and 36, respectively. The second end 36 is secured to the frame 14 of the buckle 10 by suitable means. As shown in FIG. 4, by way of example only, the second end 36 of the band 12 is looped around the second end bar 22 of the buckle 10 and secured to itself by suitable means, such as by stitching or the use of an adhesive. The first end 34 of the band 12 is termed the "free" end and is looped around the body part of the user or article and secured to the buckle 10 as described hereafter.

As shown in FIGS. 3 and 4, a plurality of apertures 38 are formed in the band 12 and extend linearly and coaxially from the first end 34 a short distance along the length of the band 12.

When it is desired to secure the band 12 about a body part, such as the wrist of a user, the buckle 10 having the second end 36 of the band 12 connected thereto is placed in position on the wrist and the first end 34 looped around the wrist into proximity with the buckle 10. The first or free end 34 of the band 12 is passed underneath the first side bar 20 of the buckle 10 until the band 12 comfortably encircles the wrist. The tongue 24 is then pivoted until the first end 26 of the tongue 24 engages one of the apertures 38 in the band 12. This secures the band 12 about the wrist of the user. The first end 34 of the band 12 from the point of connection of the aperture 38 in the band 12 with the tongue 24 of the buckle 10 is then passed through the opening 32 formed in the buckle 10 underneath the bottom surface of the second end 36 of the band 12, as clearly shown in FIG. 4. This positions the first end 34 of the band 12 in a secure position underneath the second end 36 of the band 12 and eliminates the need for an additional loop attached to the second end of the band 36 to receive the free end 34 of the band 12.

In summary, there has been disclosed a unique buckle for use with bands or straps, particularly, wrist watch bands, which eliminates the need for an additional loop required to secure the free end of the band in place after the free end of the band has passed through and engaged the buckle. The buckle of the present invention provides a clean, aesthetic appearance in addition to its free end attachment features. Further, the secure positioning of the free end of the band underneath the other end of the band prevents movement and the resulting fraying of the free end of the band common to most watch bands.

What is claimed is:

1. A buckle for a band having first and second ends and a plurality of co-axially spaced apertures formed in the band adjacent the first end, the second end of the band being fixedly connected to the buckle, the buckle comprising:

a frame having first and second opposed, side bars and first and second spaced end bars, the first end bar being fixedly joined to one end of the first and second side bars, the second end bar being releasably joined to the other end of the first and second side bars;

an intermediate bar disposed between and fixedly joined to the first and second side bars, the intermediate bar being spaced between the first and second end bars of the frame to form an aperture between itself and one of the first and second end bars of the frame for receiving the first end of the band underneath the second end of the band connected to the frame;

a tongue pivotally mounted on the intermediate bar; and wherein a rigid structure for the frame is formed solely by the fixedly joined first end bar, the intermediate bar and the first and second side bars.

2. A buckle watch band comprising:

a flexible band having first and second ends;

a plurality of co-axially spaced apertures formed in the band extending from the first end; and a buckle, the buckle comprising:

a frame having first and second opposed side bars and first and second spaced end bars;

the first end bar being fixedly joined to one end of the first and second side bars;

the second end bar being releasably joined to the other end of the first and second side bars;

the second end of the band being connected to the second end bar of the frame;

an intermediate bar disposed between and fixedly joined to the first and second side bars, the intermediate bar being spaced from the second end bar of the frame to form an opening between itself and the second end bar of the frame for receiving the first end of the band underneath the second end of the band;

a tongue pivotally mounted on the intermediate bar, the tongue being releasably engageable with one of the apertures in the band; and wherein a rigid structure for the frame is formed solely by the fixedly joined first end bar, the intermediate bar and the first and second side bars.

* * * * *